US009168444B2

(12) United States Patent
Overcash

(10) Patent No.: US 9,168,444 B2
(45) Date of Patent: Oct. 27, 2015

(54) MINIATURE GOLF GAME

(71) Applicant: Duane Keith Overcash, Bend, OR (US)

(72) Inventor: Duane Keith Overcash, Bend, OR (US)

( * ) Notice: Subject to any disclaimer, the term of this patent is extended or adjusted under 35 U.S.C. 154(b) by 2 days.

(21) Appl. No.: 14/224,092

(22) Filed: Mar. 25, 2014

(65) Prior Publication Data

US 2015/0273299 A1 Oct. 1, 2015

(51) Int. Cl.
*A63B 69/36* (2006.01)
*A63B 67/02* (2006.01)

(52) U.S. Cl.
CPC ..... *A63B 67/02* (2013.01)

(58) Field of Classification Search
CPC ..... A63B 67/02; A63B 69/3676
USPC ..... 473/157–163, 180, 181, 182–185
See application file for complete search history.

(56) References Cited

U.S. PATENT DOCUMENTS 2,794,646 A 6/1957 Knott
3,366,388 A * 1/1968 Del Raso ..... 473/153
3,762,718 A * 10/1973 Culley ..... 473/160
3,844,565 A * 10/1974 Gigliotti ..... 473/159
3,862,760 A * 1/1975 Davis ..... 473/159
4,098,507 A * 7/1978 Hudon ..... 273/108.21
4,596,391 A * 6/1986 Carolan, Jr. ..... 473/158
4,850,594 A * 7/1989 Manzione ..... 473/162
4,949,970 A * 8/1990 Culley ..... 473/160
5,108,101 A * 4/1992 Postula ..... 473/158
5,725,438 A * 3/1998 Dennesen ..... 473/163
5,749,789 A * 5/1998 Karl ..... 473/162

* cited by examiner

*Primary Examiner* — Mark Graham

(57) ABSTRACT

A first embodiment of the invention presented herein describes a miniature golf game that has three components, a putting green, a tee base, and obstacles. The putting base comprised of a tee platform, a tee and bumps representing obstacles. The putting green has one or more depressions simulating sand trap hazards and/or water hazards and a rotatable disk having hole simulating a golf cup, the center of hole positioned away from the center of the rotatable disk By positioning the putting green in various orientations relative to the tee base, orienting the tee base in various positions relative the putting green, placing the obstacles in various positions between the putting green and the tee base, and finally rotating the rotatable disk relative to the putting position so the hole from the putting green, a virtually infinite number layouts may be created. Other embodiments are presented.

6 Claims, 4 Drawing Sheets

101 putting green
102 green base
103 top surface
104 sand trap
106 water hazard
107 circular depression
108 circular disk
110 obstacle
111 circular hole
2a
2b
107 fairway
116 bump
116 bump
118 tee
120 tee platform
122 tee base 116 bumps
118 tee
120 tee platform 102 green base
107 circular depression
111 circular hole
108 circular disk
104 oval depression
112 beveled edge 201 putting green
203 top surface
211 circular hole
208 octagonal disk
209 octagonal cavity
224 obstacle
218 tee
2c
207 fairway
220 oval beveled edge
202 putting green base
222 Putting green bevel edge
204 oval cavity
2b 208 octagonal disk
211 circular hole
209 octagonal cavity 204 oval cavity
202 putting green base
222 putting green beveled edge
220 oval beveled edge

MINIATURE GOLF GAME

This application claims the benefit of the U.S. Provisional Patent Application No. 61/810,128 filed Apr. 9, 2013 by the present inventor. This provisional patent application is incorporated herein by reference.

BACKGROUND OF THE DISCLOSURE

There exists many versions of miniature golf games. Some commercial golf games are played outdoors with multiple greens and large putting surfaces; others use a board placed on tabletops. Still others use apparatus that is portable with many components that may be placed indoors or outdoors. However there is a need for a miniature golf game with a small number of inexpensive components that give an unlimited variety of layouts and shot difficulties to play with.

SUMMARY OF THE DISCLOSURE

A first embodiment of the invention presented herein describe a miniature golf game that has a portable putting green that may be placed on a horizontal flat surface such as a floor or rug in a house, or outdoors on level ground. The portable putting green has one or more depressions or cutouts simulating sand trap hazards and/or water hazards. Also imbedded in the putting green is a rotatable disk having hole simulating a golf cup, the center of the hole positioned away from the center of the rotatable disk. Also included in the first embodiment is a tee to be placed away from the green, a base holding the tee, obstructions located on the tee base, the obstructions serving to constrain the path of a shot toward the hole. Also included are two obstacles to place between the putting green and the tee base. Alternate embodiments are presented.

The first embodiment miniature golf game is set up by placing the putting green on a flat level horizontal surface, placing the tee base a distance from the putting green, and placing the obstacles between the putting green and the tee. By positioning the putting green in various orientations relative to the tee base, orienting the tee base in various positions relative to the putting green, placing the obstacles in various positions between the putting green and the tee base, and finally rotating the rotatable disk relative to the putting position, a virtually infinite number of game layouts may be created for a player.

NUMBER/PART NAME

Figures 1A, 1B, 1C:
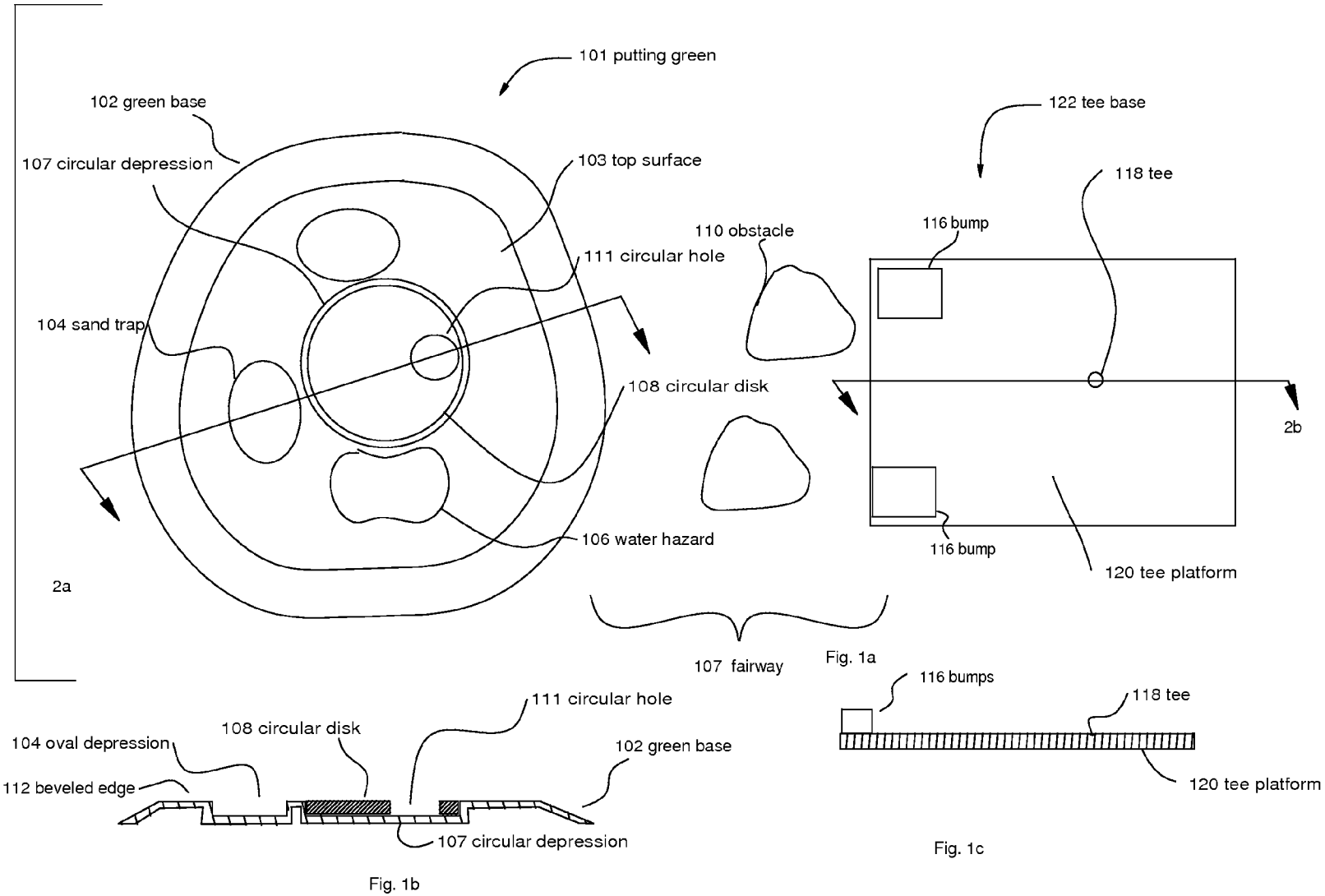
FIG. 1*a* illustrates an overview of the components of the miniature golf game of a first embodiment of the present invention.
FIG. 1*b* illustrates a cross sectional view of the putting green component of the first embodiment of the present invention.
FIG. 1*c* illustrates a cross sectional view of the tee base of the first embodiment of the present invention.

101 putting green
102 putting green base
103 top surface
104 oval cavity
106 pinched oval cavity
107 circular cavity
108 circular disk
110 obstacle
111 circular hole
112 beveled edge
116 bumps
118 tee
120 tee platform
122 tee base
201 putting green
202 putting green base
203 top surface
204 oval cavity
208 octagonal shaped disk
209 octagonal shaped cavity
211 circular hole
218 tee
220 oval beveled edges
222 putting green beveled edge
224 obstacles

DETAILED DESCRIPTION

In the following, if more than one similar part is shown in a figure, only one may have a part number pointing to it. The terms right, left, rotated clockwise and counterclockwise apply to the figure the text refers to. The term layout refers to the positioning of the putting green on a horizontal surface, the rotational position of the disk relative to the putting green, and the positioning of the obstacles and the tee base relative to each other and to the putting green.

FIG. 1*a* shows a first embodiment of the present invention. The first embodiment consists of a putting green 101, a tee base 122, and two obstacles 110. FIG. 1*b* is a cross section of putting green 101. Putting green 101 is constructed using a putting green base 102 made of a rigid molded plastic. Putting green base 102 has a top surface 103, a beveled edge 112 on the periphery of the putting green base, two oval cavities 104 representing sand traps, a pinched oval cavity 106 representing a water hazard, a circular cavity 107, and a circular disk 108, matched to fit removably and tightly into a circular cavity 107. A circular hole 111 representing a cup is positioned on a circular disk 108 near an edge of circular disk 108. In the first embodiment, cavities are depressions in the molded plastic.

In the first embodiment, tee base 122 consists of a tee platform 120 constructed out of molded plastic, a tee 118 constructed by making a small depression in the tee platform 120; and bumps 116, also constructed out of molded plastic, is attached to the tee platform 120. Tee base 122 has a cross section as illustrated in FIG. 1*c*. Also included in the first embodiment are two obstacles 110 made of routed plastic having the shape of a rock.

The first embodiment is an attractive way to provide a golf game for children as well as adults and may be used indoors or outdoors. Referring to FIGS. 1*a*, 1*b* and 1*c*, putting green base 102, has approximate size of 23 inches by 26 inches, with trap hazards and water hazard cavities of size 4 inches by 6 inches. The regular circular disk 108 is made of foam that is colored green, and has diameter of 9.5 inches. The hole has diameter of 4.25 inches and has a center positioned 1.5 inches from the center of circular disk 108. The tee 118 has a width approximately a quarter of an inch, just small enough to hold a golf ball in position.

In the first embodiment, putting green 101 and tee base 122 may be placed on an inside floor or on an approximately flat surface outdoors with obstacles 110 positioned between the putting green and the tee base.

Figures 2A, 2B, 2C:
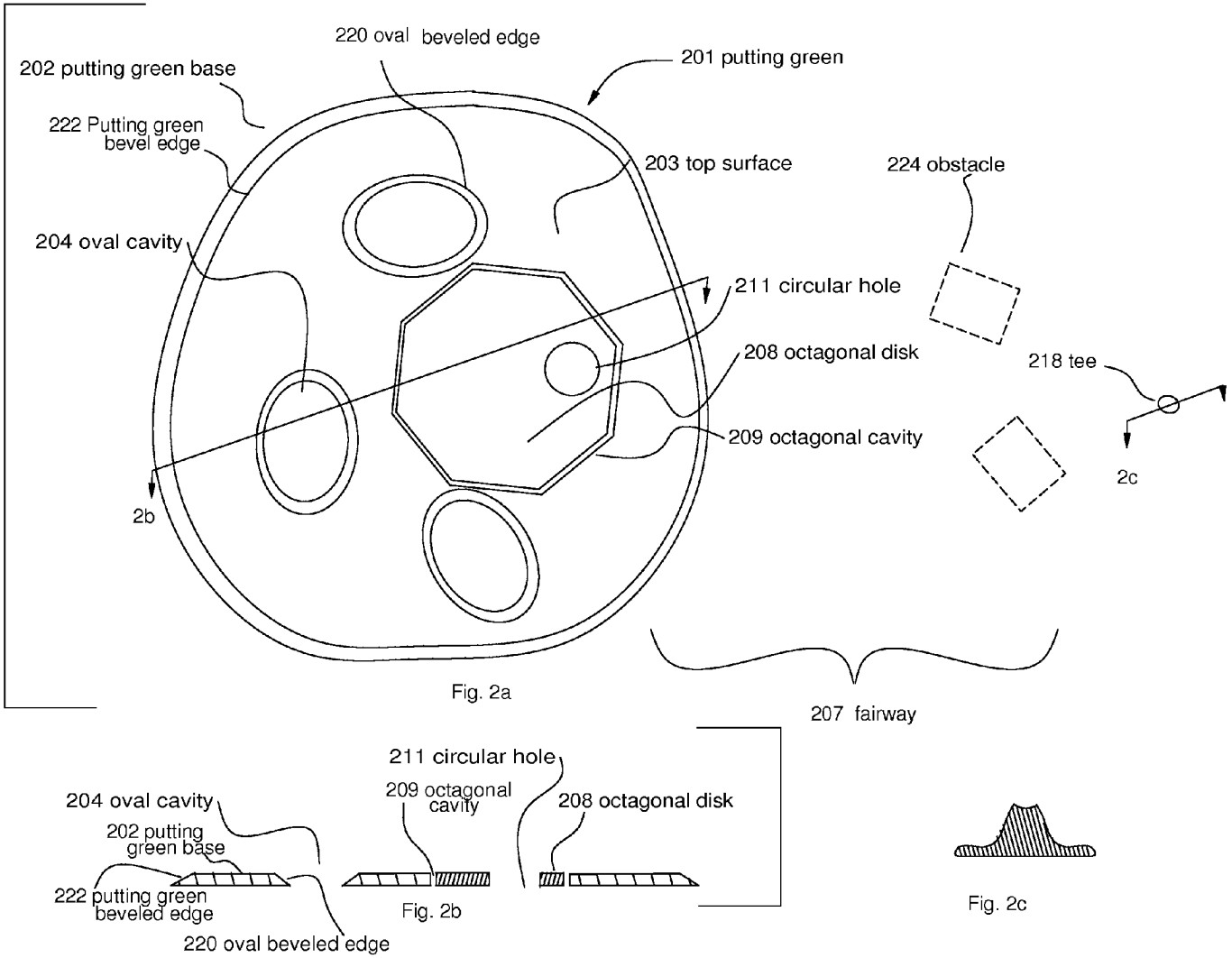
FIG. 2*a* illustrates an overview of the components of the miniature golf game of a second embodiment of the present invention.
FIG. 2*b* illustrates a cross sectional view of the putting green component of the second embodiment of the present invention.
FIG. 2*c* illustrates a cross sectional view of the tee base of the second embodiment of the present invention.

FIG. 2*a* shows a second embodiment of the present invention. The second embodiment consists of a putting green 201 and a tee 218. The putting green is constructed from a putting green base 202. Putting green base 202 is constructed from a flat surface such as a rug remnant, or a piece of artificial turf.

The putting green base 202 has base beveled edges 222 with two oval cavities 204 having oval beveled edges 220, a regular octagonal shaped cavity 209, an octagonal shaped disk 208 matched to fit removably and tightly into octagonal shaped cavity 209. A circular hole 211 is positioned in the octagonal disk near an edge of octagonal shaped disk 208. Tee 218 is constructed out of plastic, having a shape with cross section illustrated in FIG. 2*c*. FIG. 2 *c* is shown in expanded scale relative to FIGS. 2*a* and 2*b*. In the second embodiment, the cavities are cutouts.

The second embodiment is an inexpensive way to simulate a golf game for children as well as adults and may be used indoors or outdoors. Referring to FIGS. 2*a*, 2*b* and 2*c*, putting green base 202 may be constructed from a piece of artificial turf or a rug remnant. The dimensions of the various parts of the second embodiment are similar to those of the analogous parts of the first embodiment.

Putting green 201 and tee 218 may be placed on an inside floor or on an approximately flat surface outdoors. Although not part of the second embodiment, obstacles 224 may be placed as shown in FIG. 2*a*; obstacles 224 may be any appropriately size item such as a small box, or a throw pillow.

FIGS. 3*a* through 3*f* illustrate various layouts and the affect the layouts have on shot placement and difficulty. These figures apply to the first embodiment, but with straightforward variations will apply to the second embodiment and alternate embodiments.

Figure 3A:
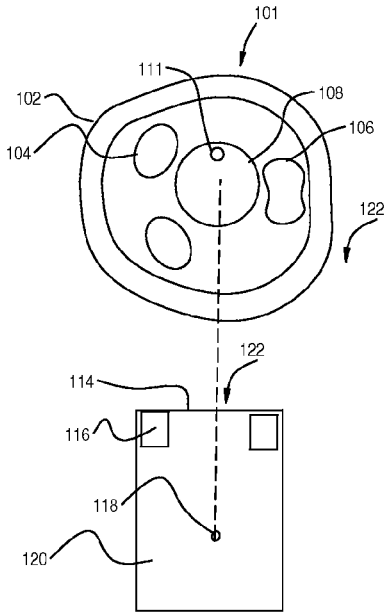
FIGS. 3*a* through 3*f* illustrate various configurations of the miniature golf game of the first embodiment of the present invention with and without the obstacle deployed and with various positioning of obstacles, the rotatable disk, the putting green base and the tee base.

FIG. 3*a* illustrates a simple layout with no obstacles and a par-one straight path from the tee to the cup.

Figure 3B:
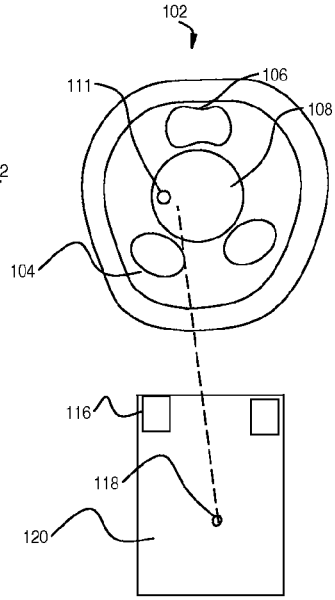

FIG. 3*b* is similar to FIG. 3*a* except that the putting green base 102 is rotated 90 degrees counterclockwise so the path from the tee to the cup is slightly to the left. A path to the cup can be achieved with a single putt; however one of the oval cavities 104 is in play making it a difficult par-one shot.

Figure 3C:
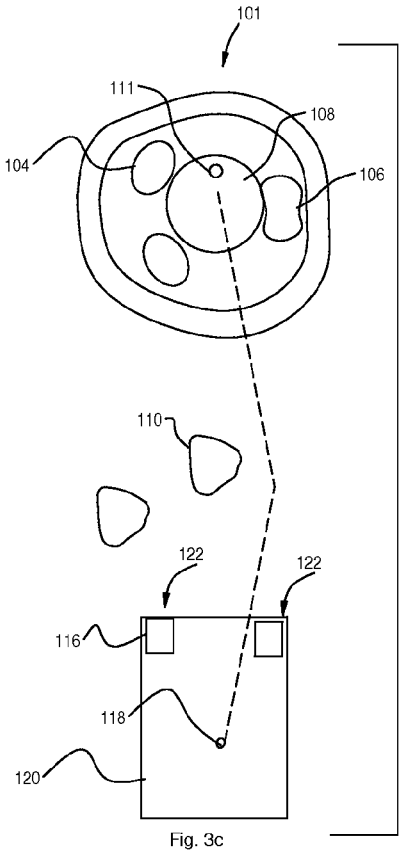

FIG. 3*c* has a similar layout as FIG. 3*a*, except tee base 122 is placed a greater distance from the putting green 101 and two obstacles 110 have been added and positioned as shown in the figure. This layout creates a par-two rather than the par-one possibility of FIG. 3*a*. Note that the shot needs to avoid one of the bumps 116.

Figure 3D:
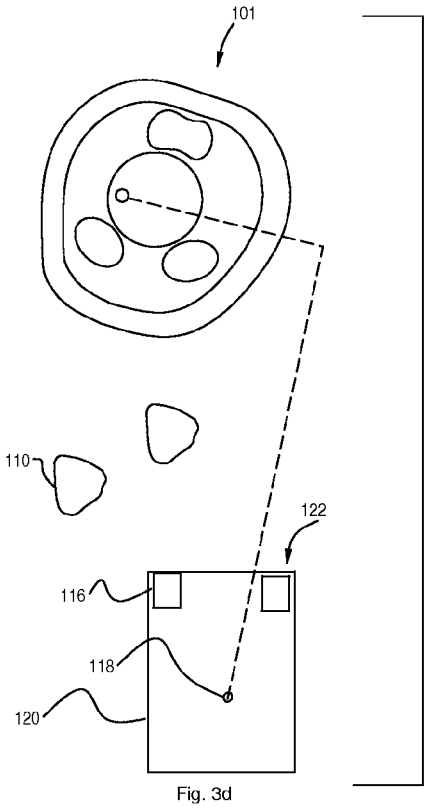

FIG. 3*d* has the putting green rotated 30 degrees clockwise from FIG. 3*b*, the rotatable disk is rotated so that the circular hole 111 is positioned to the left, the tee base 122 is positioned the same as FIG. 3*b*. and obstacles are added. This again is a par-two layout.

Figure 3E:
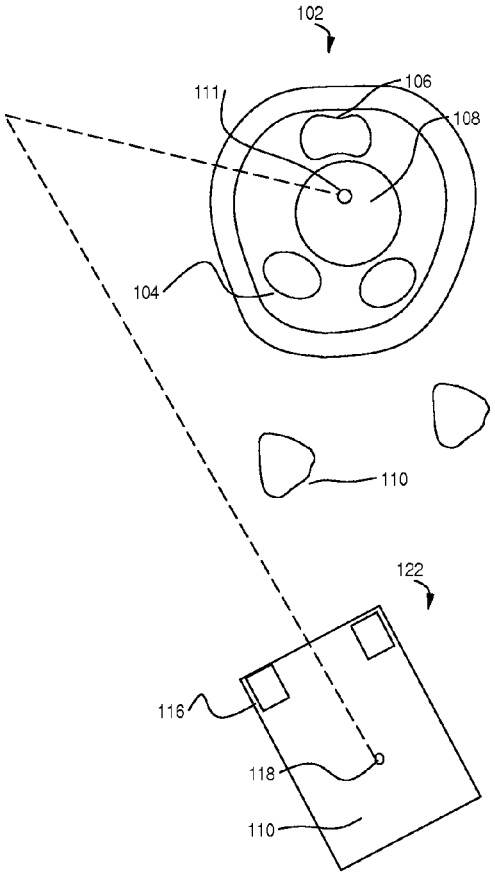
Figure 3F:
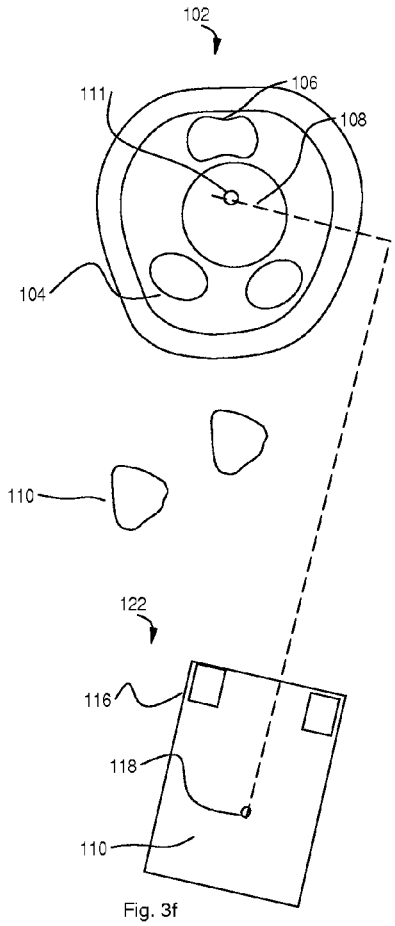

FIG. 3*e* and FIG. 3*f* show two layouts where the putting green, rotatable disk and obstacles are positioned similarly, but tee base 122 are rotated 30 degrees to the left and to the right respectively. In both cases they are two-par layouts, but different shot placements are required FIGS. 3*a* through 3*f* described only a few of the virtually infinite robust number of layouts possible. Other layouts such as increasing distance between green and tee, adding additional obstacles, and making rules concerning out-of-bound penalties add challenge and variety.

Alternate embodiments of the first and second embodiment are within the inventive concept presented herein. For example, the shape and dimensions of the putting green base may vary, the material that the putting green base and tee base are constructed of may be varied; the beveled edge or edges may have straight or curved bevels; the oval and pinched depressions may have different shapes, and different numbers of cavities and different locations on the putting green may be implemented. Inserts to the cavities and hole may be used, such as a tin cup inserted in the hole, and inserts in the hazard cavities simulating sand hazard or water hazards. A thin sheet of green felt, foam, or another material may be attached to the top surface 103 with the rotatable disk sized to be level with the top of the thin sheet. The thin sheet should provide the same travelling characteristics to a rolling golf ball as the circular disk.

What is claimed is:

1. A miniature golf game apparatus to be used by at least one player, said miniature golf game apparatus capable of being played on a flat horizontal surface, said miniature golf game apparatus comprised of at least two components, said at least two components comprised of a putting green, a tee base, and optionally at least one obstacle, said putting green further comprised of:

a putting green base, said putting green base capable of lying on said flat horizontal surface; said putting green base having a top surface; said top surface having an interior, said top surface having at least one hazard cavity, said at least one hazard cavity being positioned on said interior of said top surface;

a disk cavity, said disk cavity positioned on said top surface;

a disk adapted to rotationally fit in said disk cavity, said disk having a center, said disk having a hole that accommodates a golf ball, said hole positioned such that said center is at least 0.5 inches away from said center of said disk; wherein each of said at least two components may be positioned relative to each other anywhere on said flat horizontal surface; and furthermore position said tee base on said flat horizontal surface in various rotational directions relative to said putting green, and furthermore positions said disk within said putting green base in various rotational directions relative to said putting green base, then the miniature golf game apparatus allows said at least one player to create a large and challenging multitude of layouts of said miniature golf game.

2. The miniature golf game apparatus of claim 1 wherein the disk cavity has a shape of a circle or a regular polygon and the disk is matched to fit rotationally, removably and tightly into said disk cavity.

3. The miniature golf game apparatus of claim 1, said tee base comprising:

a tee platform, said tee platform being capable of lying horizontally on said flat horizontal surface;

a tee, said tee capable of being attachable to said tee platform.

4. The miniature golf game apparatus of claim 3 comprising at least one obstacle.

5. The miniature golf game apparatus of claim 3 is dimensioned as follows:

said putting green base has dimensions of approximately 23 inches by 26 inches said at least one hazard cavity each has dimensions of approximately 4 inches by 6 inches;

said disk is made of foam that is colored green, and has a first diameter of approximately 9.5 inches;

said hole has a second diameter of approximately 4.25 inches and has said center positioned approximately 1.5 inches from said center of said disk.

6. The miniature golf game apparatus of claim 3 additionally comprising two bumps permanently attached to said tee platform, said two bumps and said tee and relatively positioned so that drives from said tee need to avoid said two bumps when attempting to reach the putting green, thereby further increasing challenges of said miniature golf game apparatus.

* * * * *